United States Patent [19]

Crane

[11] 4,039,121

[45] Aug. 2, 1977

[54] CLIP FOR USE WITH BERRY BASKET TRAYS IN STACKS AND COVER SHEET

[75] Inventor: Walton B. Crane, Sherman Oaks, Calif.

[73] Assignee: A & E Plastik Pak Co., Inc., City of Industry, Calif.

[21] Appl. No.: 746,464

[22] Filed: Dec. 1, 1976

Related U.S. Application Data

[63] Continuation-in-part of Ser. No. 675,981, April 12, 1976, abandoned, which is a continuation of Ser. No. 576,807, May 12, 1975, abandoned.

[51] Int. Cl.[2] ..... B65D 5/44; B65D 25/22

[52] U.S. Cl. ..... 229/52 A; 229/DIG. 11; 229/34 HW; 16/125; 24/87 TB; 206/821

[58] Field of Search ..... 229/52 A, 52 AW, 23 R, 229/DIG. 11; 16/125, 114; 24/73 P, 73 PF, 208 A; 224/48 R

[56] References Cited

U.S. PATENT DOCUMENTS

| | | | |
|---|---|---|---|
| 2,971,232 | 2/1961 | Crane | 24/87 TB |
| 2,987,198 | 6/1961 | Crane | 206/821 X |
| 3,074,615 | 1/1963 | Johnson | 229/52 AW |
| 3,106,332 | 10/1963 | Dieguez | 229/52 AW |
| 3,211,326 | 10/1965 | Davis | 229/52 AM X |
| 3,604,052 | 9/1971 | Bringer | 16/125 |
| 3,750,936 | 8/1973 | Crane | 229/52 AW |
| Re. 26,386 | 5/1968 | Crane | 229/23 R |

*Primary Examiner*—Davis T. Moorhead
*Attorney, Agent, or Firm*—Forrest J. Lilly

[57] ABSTRACT

The disclosure is of a clip, constructed of plastics material, adapted to secure together, in a stack, a number of berry box trays, all of the general type disclosed in my prior U.S. Pat. No. 3,750,936, the clips being adapted to operate at certain times as a handle, and at others to coact with a paperboard dust cover sheet to releasably bind the latter in a secure manner onto the top tray of a stack of such trays.

10 Claims, 10 Drawing Figures

4
2
31
C
18
32
19
24
20
C
24
12
33
34
17
45
36
24
4
33
25
29
10
27
20
25
36
11
13
20
2
11
12

24
20
19a
13
16
17
35
19
5
34
24
29
19a
20
17
19
5
16
35

3
52

56
54
C
55
55
48
44
46
45
47
2a
2a
49
69
69
60
60a
60
60a
64
68
68
64
61
61
62
66
62
66
67
67
3

24
20
25
13
17

44
46

47
45

52
C 54
44
48
45
49
60
66

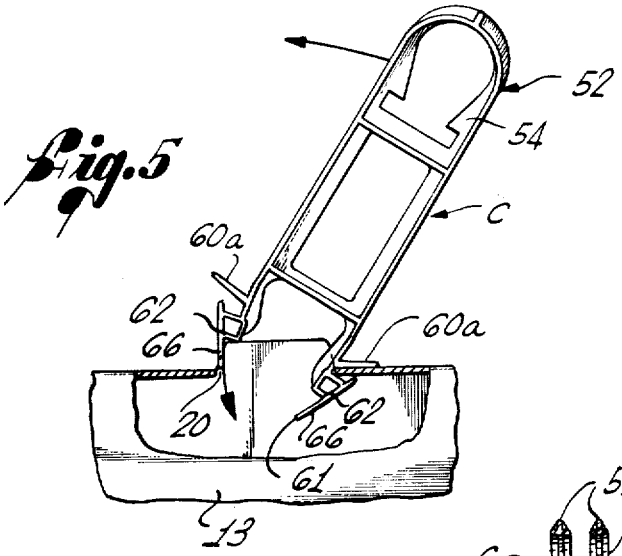
Fig. 5
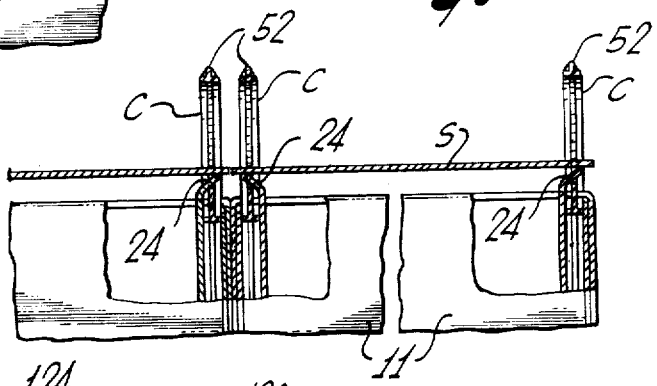
Fig. 8
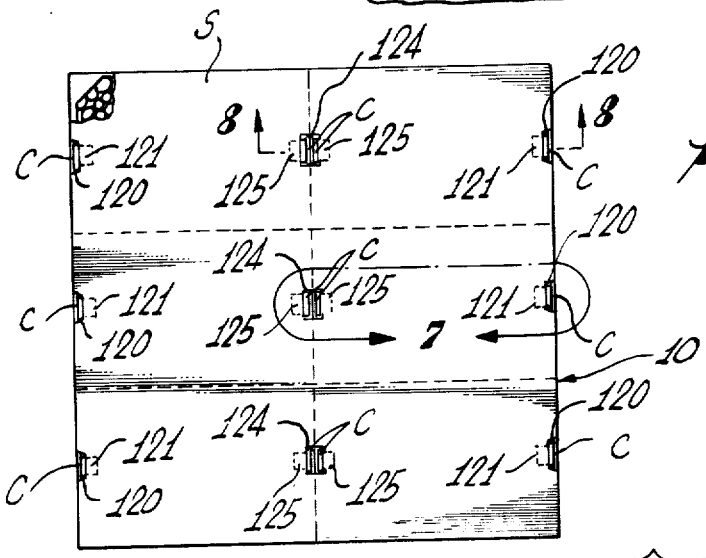
Fig. 6
Fig. 7
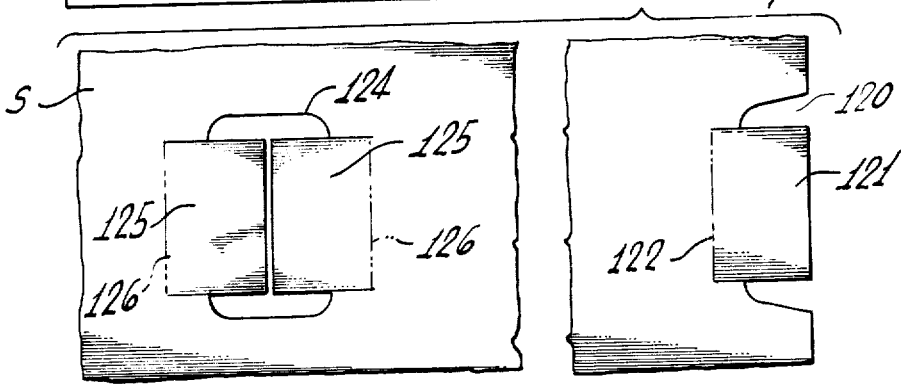

CLIP FOR USE WITH BERRY BASKET TRAYS IN STACKS AND COVER SHEET

RELATED APPLICATION

This application is a continuation-in-part of my co-pending earlier application Ser. No. 675,981, filed Apr. 12, 1976, now abandoned, which was a continuation of my parent application, Ser. No. 576,807, filed May 12, 1975, now abandoned.

FIELD OF THE INVENTION

This invention relates generally to a certain type of known basket container or tray, adapted to hold twelve strawberry baskets of the conventional sort, the tray being of the type illustrated in my prior U.S. Pat. No. Re. 26,386; and it relates also to clips usable therewith for stacking, lifting and constraining a number of such trays in a column; together with a dust cover cooperable with such tray and clips for protecting the contents of a top tray of a stacked column of such trays, or of each of a set of such columns, from dust while being transported from the field.

BACKGROUND OF THE INVENTION

A box tray of the general type utilized, with a small modification, by the present invention, was disclosed in my U.S. Pat. No. Re. 26,386, May 7, 1968. My U.S. Pat. No. 3,750,936 discloses portions of the tray, in a two tier stack, and also a metal wire clip serving as a stacking guide and handle by which a two tier stack of the trays may be conveniently carried, and whose upper extremities may be bent over to hold a cover sheet in place. See also my U.S. Pat. No. 2,971,232, showing a clip with downwardly spreading leg portions, the clip being insertable from below, and supporting each tray from below.

Problems encountered with these facilities have included undue cost of the metal clips, and insecurity of the cover sheets when bound in the simple manner of the prior art. Objectives of the invention include the provision of a unique and improved clip, fabricated from plastics material, unique and improved coaction between the clip and container, and a novel and improved interlock between a formation on the upper portion of the uppermost clip of a stack of trays with a unique, effective and improved locking conformation formed in a novel cover sheet.

BRIEF DESCRIPTION OF THE INVENTION

The present invention provides a novel clip formed of well-known injection moldable plastics material and which is conformed to engage and interlock with a cover sheet. The upper part of the clip is useful as a carrying handle, and is formed also to interlock with certain novel locking means in the cover sheet. Such clips are inserted in vertical passages in end wall structures of the trays. Each clip has at its lower end outwardly turned toes which cooperate with an aperture in the top end wall structure to enter therethrough, and then to expand beyond the ends of such aperture so as to engage the underside of the end wall for carrying purposes. A second tray can then be run down on the upwardly projecting clips, which are long enough to emerge above the end walls of such second tray. A novel interlocking means is provided on this emergent upper portion of the clip adapted to engage with novel locking formations in the cover.

This present application is directed to the clip per se. Reference is directed to my co-pending application Ser. No. 746,463, filed coincidentally herewith, directed to the combination of stacked trays, clip and cover sheet.

BRIEF DESCRIPTION OF THE DRAWINGS

FIG. 5 is a view taken on line 5—5 of FIG. 4, but with the upper tray omitted, and showing the clip partially inserted into the aperture in the top of end wall of a lower tray, only the upper portion of which is shown, the blade and toe portion on one side being engaged inside the slot 20, and the blade on the other side rocking into slot 20;

FIG. 6 is a plan view of a cover sheet overlying six trays in a 3 × 2 stack, and with the cover sheet on top;

FIG. 7 is an enlargement of the area encircled by the numeral 7 on FIG. 6, with a portion broken out; and FIG. 8 is a view on line 8—8 of FIG. 6, showing the cover sheet locked onto the upper tray of a stack.

DESCRIPTION OF AN ILLUSTRATIVE EMBODIMENT OF THE INVENTION

Figure 1:
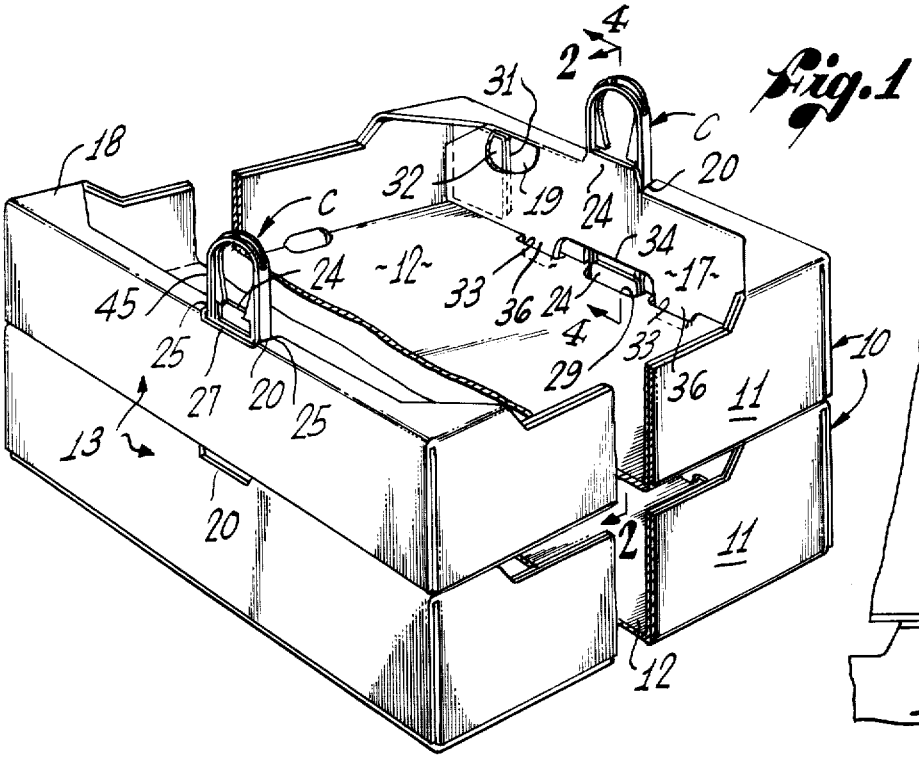
FIG. 1 is a perspective view of two of the trays and corresponding clips in accordance with the invention, the trays stacked on one another, these being the two bottom trays of a stack.
Figure 4:
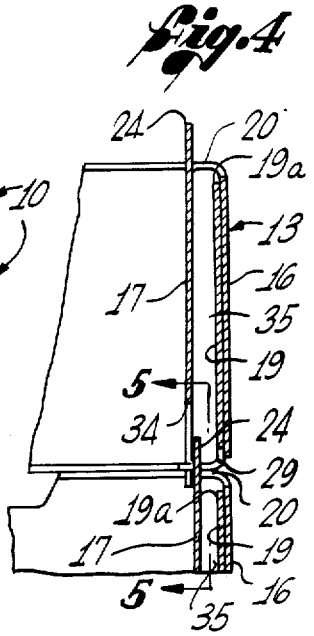
FIG. 4 is a section in accordance with line 4—4 of FIG. 1, the clip being omitted for clarity of illustration of the container structure.

The drawings show the parts pertinent to the present invention of a container of the kind shown in my Reissue U.S. Pat. No. 26,386, and my U.S. Pat. No. 3,750,936. The walls of this container, and the cover sheet also, are to be understood as preferably composed of known reinforced corrugated paperboard stock, or equivalent. This container 10 has two-ply side walls 11, a single-ply bottom wall 12, and multiple-ply end wall structures 13. In the container here illustrated, the end wall structure includes two generally vertical outside and inside panels 16 and 17, spaced from and integrally connected to one another by a narrow top wall 18. At the end of the bottom wall is an integral, turned-up end wall panel 19 which lies adjacent the inner surface of and is adhesively joined to the outside panel 16 of the end wall structure. The upper edge 19*a* of the panel 19 terminates at a spacing distance below the top panel 18.

A slot 20 is formed in the central region of the narrow top end panel 18. This slot is made while the paperboard is still flat in "blank" form by a three-sided, generally U-shaped, or more exactly, trapezoidal cut, in a manner so that, when the paperboard blank is erected, there is produced a tab 24 projecting up from the center of the panel 17, leaving the slot 20 cut through the top panel 18 on preferably (though not essentially) converging diagonal cut lines producing diagonal slot ends 25. For a more detailed disclosure, see my U.S. Pat. No. 3,750,936. These slot ends are joined by a cut forming an edge 27 with angular or rounded ends, and which may dip slightly below the upper edge of the outer end panel 16. Formed in bottom wall 12, in vertical alignment with slot 20, is a bottom slot 29, of substantially the length of slot 20.

The outside and inside plies of the side walls have flaps 31 and 32, respectively, (FIG. 1), at the ends thereof which are turned inwardly, and are incorporated in the end wall structure 13 between the panels 16 and 17. These flaps, however, terminate short of the slots 20 and 29. All this structure is shown and described, excepting for minor detail, in the aforementioned U.S. Pat. No. Re. 26,386.

Thus, with this construction, there is a vertical space or air shaft 35, for reception of a presently described clip, between the contacting vertical end panels 16 and 19, on one side, and, on the other, the upper end portion of end panel 17 and, at the bottom, the confronting face of tab 24 from the tray below. This space or air shaft 35 between the slightly inclined panel 17 and the end panels 16 and 19, opens at the top via the slot 20, and at the bottom via the substantially equal width slot 29.

Two notches 33 are indented into the end edges of bottom wall 12, in positions spaced laterally outwardly from the center notch 29, and a centrally located notch 34 is formed in the lower edge portion of inner wall 17, so as to bridge over the central notch 29 and the tab 24 projecting upwardly from the inside end wall ply 17 of the container below. Outside notch 29, on each side, the wall 17 has a depending tab 36 that is received in the corresponding notch 33. The corresponding edges of the notches 29 and 33, as seen in FIG. 1, are in rectilinear alignment, and are deep enough that the wall 17 tends to lean inwardly of the box towards its lower edge to a small degree — say 2° or 3°. The dimensions are also such that the vertical shaft or clip guideway 35 (FIG. 5), as measured between the upper extremity of the vertical wall 19 and the portion of the very slightly tilted wall 17 just opposite, is substantially equal in width to the distance between the lower extremity of the wall 19 and the upstanding tab 24 of the tray immediately below. The guideway 35 for the clip, to be described presently, is thus effectively parallel sided, and vertical.

Figure 2:
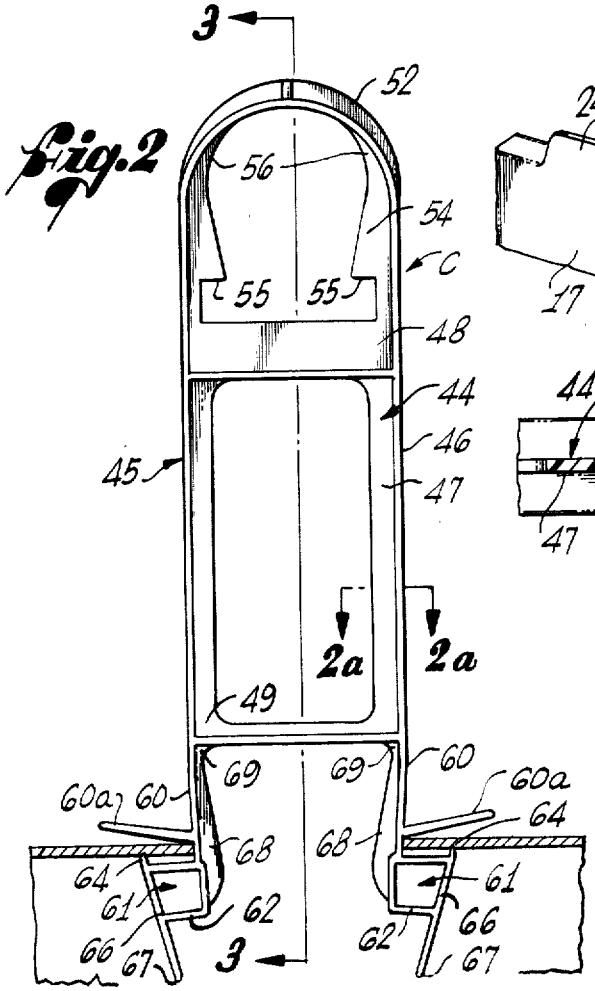
FIG. 2 is a side elevational view of a clip in accordance with the invention, the view being taken in the aspect of line 2—2 of FIG. 1, but with the upper tray not yet in place, and showing only the upper portion of the lower tray.
Figure 1A:
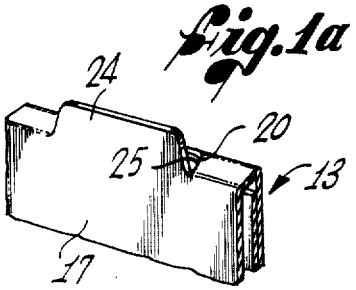
FIG. 1*a* is an enlarged fragmentary view taken from FIG. 1, but with the clip removed.
Figure 2A:
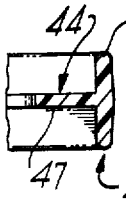
FIG. 2*a* is a section taken on line 2*a*—2*a* on FIG. 2.
Figure 3:
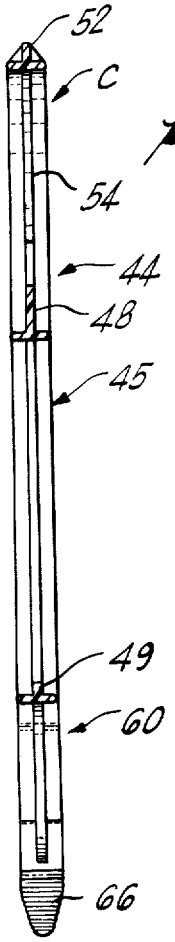
FIG. 3 is an edge elevation of the clip.

Reference is now particularly directed to FIGS. 2–3 showing the molded plastics clip C used in the invention to laterally position the trays of a stack, to serve as handles, and to function also as a means for securing the top cover or binder sheet S in position. This clip C has a generally flat, relatively stiff, body frame 44, of generally rectangular outline, and of substantially equal outside widths at its upper and lower ends. In its preferred form, it is defined by parallel longitudinal side rails 45 of T-section, having longitudinal flanges 46 and inwardly turned medial longitudinally extending webs 47. Upper and lower transverse bracing flanges 48 and 49 extend between the flanges 46 at the upper and lower ends of the body frame 44, and the rails 45 thereabove, continue upwardly for a distance, as shown, and then curve inwardly to join and form a U-bend top 52. The webs 47 also extend upwardly above the transverse flange 48, being bridged across by a medial tranverse web 54 above the flange 48. Slender vertical extensions of this web 54, at opposite ends thereof, widen to form downwardly facing locking shoulders 55, and above the extremities of these shoulders, the web tapers to a narrow width around the inside of the U-bend top 52, as at 56.

Below the level of the transverse flange 49, the side rails 45 continue on down, preferably with some convergence (approximately 13° on a side) as cantilevered legs 60, at the lower extremities of which are outwardly turned toes 61, in the preferred form of trapezoidal box frames 62, furnished on top, at their extremities, with prongs 64. On the outer ends of the trapezoidal box frames are depending, preferably convergent guide blades 66, e.g., 35° to vertical on a side, which are generally downwardly pointed at their lower ends, as at 67. The legs 60 are made flexible and bendable inwardly or toward one another by shaping their webs 68 to have narrow, fairly readily inwardly bendable "hinge" sections 69 a short distance below their upper ends. These legs then can be resiliently bent inwardly to insert them into the box end apertures 20 (FIG. 6). The width dimension of the clips, at about the vertical mid-points of the guide blades 66, is approximately equal to the length of the box end apertures 20.

Just above the toes 61, the legs 60 have outstretched, slightly upwardly inclined arms or wings **60*a*. These serve the purpose of preventing fall of the clips when released by the hand after insertion. FIG. 5 shows the clip oriented for easy insertion. The clip is tilted, as shown, the right hand blade inserted entirely through the slot 20 in the top wall, and is moved to the right, in FIG. 5, so the portion of the top wall 18 of the tray adjacent to the slot 20 engages the clip between the top of the toes 61 and an arm 60*a*. By rocking the clip counterclockwise, as seen in FIG. 5, the clip can then be inserted, the blade on the left hand side (FIG. 5) bending slightly as it works down across the edge of the slot 20. The clip is then easily worked into the normal working position of FIG. 2, where the toes 61 are cleared of the slot 20, and reach outwardly, as seen. The prongs 64 then engage under the wall 18, outside slot 20**.

The two legs of the clip thus can be resiliently bent to enable the toes to enter the apertures 20; and once through, the legs resiliently return to their initial positions, such that the toes and their prongs 64 will engage the underside of the wall 18, as in FIG. 2.

In the preferred embodiment of the invention, the width of the clip flanges is very close to the dimensions of the spacing distance between the wall 19 and the portion of the sloping wall 17, just below the end wall top 18, and therefore also to the spacing distance between the tab 24 and the lower portion of the opposed end wall member 19. The clip therefore slides fairly easily, with no more than slight frictional resistance or interference, in this space 35 so defined.

Assuming now that the first tray is loaded, the clips are in the preferred position of FIG. 7, and that a second loaded tray is to be added to the stack, the second tray is lowered onto the first, the upreaching portions of the clips C being received through the lowermost apertures 29 of the second tray and being thus guided up the shaft 35, to emerge above the aperture 20 in the uppermost end wall 18, as seen in FIG. 1.

Additional pairs of trays now may be added, and this process may be continued to the top of a stack.

The top cover sheet S for one stack, or a group of stacks, of the trays, assembled with use of the clips 44, and its coaction with the clips and trays, will next be described. FIGS. 6, 7 and 8 cover the top tier of six trays of a six tray stack assembly arranged in two adjacent rows of three. Clips 44 are shown partially emergent from the top cover sheet S. Thus, the clips are in the relative positions shown in FIG. 1.

The cover sheet S, which as shown covers six trays, in a 2 × 3 array, (see FIGS. 6, 7 and 8) has outer edge notches 120 adapted to receive the upper portions of the clip, and flaps 121 hinged to bend upwardly on hinge lines 122, and over the line between end-to-end trays, has slots 124 to receive the upper end portions of clips, and pairs of flaps 125, hinged to bend upwardly on hinge lines 126. With reference now to FIGS. 6, 7 and 8, when the cover sheet S is to be pressed down, the tabs 24 of the upper tray are bent angularly over, as shown, the U-bend tops 52 of the clips C assuming the position of FIG. 8.

It will be understood that the drawings and description are for illustrative purposes only, and that various changes in design, structure and arrangement are within the range of equivalents of the invention as defined by the appended claims.

What is claimed is:

1. A clip composed of a resilient plastics material, and comprising:

a vertically disposed frame of generally rectangular outline, and of substantially equal outside width dimensions at its upper and lower extremities, resiliently inwardly bendable rails depending from the lower corners of said frame, and toes turned outwardly, in opposite directions from one another, from the lower extremities of said rails.

2. The clip of claim 1, wherein:

said frame embodies a pair of generally parallel, vertically disposed and laterally spaced, longitudinal side rails;

upper and lower lateral cross members interconnecting the upper and lower end portions of said longitudinal rails, said resiliently inwardly bendable rails comprising normally downwardly convergent extensions of said side rails.

3. The clip of claim 1, including dependent guide blades on the extremities of said toes.

4. The clip of claim 2, wherein said side rails are of T-shaped cross section, comprised of flanges, and webs integral therewith and inside of and medially abutting said flanges.

5. The clip of claim 2, including a generally U-shaped upper extension from the upper extremities of said rails.

6. The clip of claim 1, wherein said legs are of T-shaped cross section, comprised of flanges, and webs integral therewith and inside of and medially abutting said flanges, the cross section of said last-mentioned flanges, in the upper regions of said rail extensions, being reduced to predispose said rail extensions to bend inwardly within said regions.

7. The clip of claim 1, including upwardly pointing prongs on the extremities of said toes.

8. The clip of claim 5 wherein said generally U-shaped upper extension contains a web contoured to form a downwardly facing shoulder on each side.

9. The clip of claim 1, wherein said resiliently inwardly bendable rails normally converge to a slight extent towards one another.

10. The clip of claim 9, including outstretched wings attached to said rails at points above said toes, and convergent blades on the outer extremities of said toes, the lower extremities of said blades depending below said toes.

* * * * *